US011211758B2

(12) United States Patent
Hoppe et al.

(10) Patent No.: US 11,211,758 B2
(45) Date of Patent: Dec. 28, 2021

(54) HAND TOOLS

(71) Applicant: MILWAUKEE ELECTRIC TOOL CORPORATION, Brookfield, WI (US)

(72) Inventors: Christopher S. Hoppe, Milwaukee, WI (US); Steven W. Hyma, Milwaukee, WI (US); Grant T. Squiers, Cudahy, WI (US); Kyle Harvey, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 295 days.

(21) Appl. No.: 16/029,337

(22) Filed: Jul. 6, 2018

(65) Prior Publication Data

US 2018/0316151 A1 Nov. 1, 2018

Related U.S. Application Data

(63) Continuation of application No. 14/805,039, filed on Jul. 21, 2015, now abandoned.

(60) Provisional application No. 62/027,606, filed on Jul. 22, 2014.

(51) Int. Cl.
*H01R 43/01* (2006.01)
*B26F 1/32* (2006.01)
(Continued)

(52) U.S. Cl.
CPC ..... *H01R 43/015* (2013.01); *B25B 15/02* (2013.01); *B25B 19/00* (2013.01);
(Continued)

(58) Field of Classification Search
CPC ..... H01R 43/015; B25B 19/00; B25F 1/02; B26F 1/32
(Continued)

(56) References Cited

U.S. PATENT DOCUMENTS 386,263 A * 7/1888 Pedersen ..... B23B 31/202 279/42
631,113 A * 8/1899 Geiser ..... B25F 1/04 7/168
(Continued)

FOREIGN PATENT DOCUMENTS

CA 2541354 9/2006
CN 2176878 9/1994
(Continued)

OTHER PUBLICATIONS

Canadian Patent Office Action for Application No. 2,949,190 dated Oct. 30, 2017 (4 pages).
(Continued)

*Primary Examiner* — Hadi Shakeri
(74) *Attorney, Agent, or Firm* — Reinhart Boerner Van Deuren s.c.

(57) ABSTRACT

A hand tool includes a body having a first end and a second end opposite the first end, a first reversible tool removably coupled to the first end, and a second reversible tool removably coupled to the second end. A first pick extends from the first reversible tool, and a second pick extends from the first reversible tool opposite the first pick. A first screwdriver bit extends from the second reversible tool, and a second screwdriver bit extends from the second reversible tool opposite the first screwdriver bit. The hand tool also includes a cap removably coupled to the body at the first end or the second end. The body is configured to resist rolling.

5 Claims, 15 Drawing Sheets

(51) Int. Cl.
*B25F 1/02* (2006.01)
*B25B 15/02* (2006.01)
*B25B 19/00* (2006.01)
*B25B 23/00* (2006.01)

(52) U.S. Cl.
CPC ..... *B25B 23/0035* (2013.01); *B25F 1/02* (2013.01); *B26F 1/32* (2013.01)

(58) Field of Classification Search
USPC ..... 7/107; 81/436, 438
See application file for complete search history.

(56) References Cited

U.S. PATENT DOCUMENTS 686,424 A * 11/1901 Smith ..... B25B 23/0035 81/438
814,020 A * 3/1906 Clifford ..... B25B 15/007 81/436
953,149 A * 3/1910 Leon ..... B26F 1/32 30/368
3,137,062 A 6/1964 Green et al.
3,255,792 A * 6/1966 Da Ruben ..... B25G 1/00 81/490
3,588,932 A 6/1971 Sedlacek
3,604,092 A 9/1971 Knickerbocker
3,628,202 A 12/1971 Brown
3,708,852 A 1/1973 Mason
3,711,921 A 1/1973 Debortoli et al.
3,742,573 A 7/1973 Kaufman
3,883,316 A 5/1975 Mason
3,896,534 A 7/1975 Kaufman et al.
3,898,724 A 8/1975 Conorich
3,997,956 A 12/1976 McKee
4,161,061 A 7/1979 Mason et al.
4,194,256 A 3/1980 Knickerbocker
4,241,496 A 12/1980 Gregson
4,434,542 A 3/1984 Forberg et al.
4,448,097 A * 5/1984 Rocca ..... B25B 15/04 81/177.4
4,451,947 A 6/1984 Frieber
4,488,462 A 12/1984 Wall
4,567,639 A 2/1986 Fasano
4,656,725 A 4/1987 Knickerbocker
4,682,412 A 7/1987 Pfeffer
4,696,090 A 9/1987 Gregson et al.
4,999,914 A 3/1991 Cheng
5,175,921 A 1/1993 Krietzman
5,179,748 A 1/1993 Lipic
5,195,230 A 3/1993 Krietzman
5,533,429 A 7/1996 Kozak
5,604,948 A 2/1997 McMahon et al.
5,613,297 A 3/1997 Dvorak et al.
5,655,294 A 8/1997 Makino
5,711,194 A 1/1998 Anderson et al.
5,758,403 A 6/1998 Fallandy
5,794,497 A 8/1998 Anderson
5,813,109 A 9/1998 Ziegler et al.
5,868,048 A 2/1999 Cassulti et al.
5,887,333 A 3/1999 Clark
5,904,080 A 5/1999 Anderson et al.
5,927,164 A 7/1999 Anderson et al.
6,026,717 A 2/2000 Anderson
6,026,718 A 2/2000 Anderson
6,032,557 A 3/2000 Anderson
6,047,619 A 4/2000 Anderson et al.
6,050,158 A 4/2000 Cassulti et al.
6,058,600 A 5/2000 Leu
6,060,801 A 5/2000 Anderson
6,082,232 A 7/2000 Anderson et al.
6,085,620 A 7/2000 Anderson et al.
6,105,474 A 8/2000 Anderson
6,109,148 A 8/2000 Anderson et al.
6,119,560 A 9/2000 Anderson et al.
6,119,561 A 9/2000 Anderson et al.
6,131,222 A 10/2000 Anderson et al.
6,181,229 B1 1/2001 Anderson
6,182,541 B1 2/2001 Anderson et al.
6,209,428 B1 4/2001 Anderson et al.
6,257,106 B1 7/2001 Anderson et al.
6,260,453 B1 7/2001 Anderson et al.
6,282,998 B1 9/2001 Beach
6,286,400 B1 9/2001 Anderson et al.
6,298,756 B1 10/2001 Anderson et al.
6,305,256 B1 10/2001 Anderson et al.
6,318,218 B1 11/2001 Anderson et al.
6,351,865 B1 3/2002 De Donato
6,356,176 B1 3/2002 Anderson
6,361,317 B1 * 3/2002 Rahman ..... A61C 3/00 433/141
6,370,993 B1 4/2002 Pitsttick
6,374,711 B2 4/2002 Anderson
6,386,078 B1 5/2002 Wu
6,494,121 B1 12/2002 Hu
6,499,168 B1 12/2002 Anderson
6,572,311 B2 6/2003 Vasudeva
6,601,285 B1 8/2003 Jonker et al.
6,615,480 B1 * 9/2003 Murphy ..... H01R 43/01 29/566.4
6,625,867 B2 9/2003 Jonker
6,655,243 B2 12/2003 Anderson et al.
6,704,992 B2 3/2004 Minor
D491,785 S 6/2004 Anderson et al.
6,978,504 B1 * 12/2005 Smith ..... B25B 15/02 7/165
7,052,128 B1 * 5/2006 Kung-Ping ..... B25B 15/02 351/42
7,096,564 B2 8/2006 Sullivan
7,127,969 B2 * 10/2006 Hsieh ..... B25B 13/06 81/121.1
7,255,028 B1 * 8/2007 Di Bitonto ..... B25B 15/02 81/439
7,266,878 B1 9/2007 Sullivan
7,458,296 B2 12/2008 Richter et al.
7,475,475 B2 1/2009 Sullivan
7,621,040 B2 11/2009 Sullivan
7,644,485 B2 1/2010 Muller et al.
7,739,930 B2 6/2010 Schunke
7,788,788 B2 9/2010 Sullivan
8,037,598 B2 10/2011 Sullivan
8,220,135 B2 7/2012 Vogel et al.
8,296,936 B2 10/2012 Lin
8,443,508 B2 5/2013 Vogel et al.
8,549,727 B2 10/2013 Lee et al.
8,844,409 B2 9/2014 Lin
9,545,710 B2 1/2017 Boice
2001/0012754 A1 8/2001 Anderson et al.
2001/0029815 A1 10/2001 Anderson et al.
2002/0005095 A1 1/2002 Anderson et al.
2002/0065178 A1 5/2002 Cook
2002/0069729 A1 6/2002 Anderson et al.
2008/0289173 A1 11/2008 Sullivan
2010/0031492 A1 2/2010 Lee et al.
2014/0123397 A1 5/2014 Powers
2014/0310882 A1 * 10/2014 Reynolds ..... B25F 1/02 7/158

FOREIGN PATENT DOCUMENTS

| | | |
|---|---|---|
| CN | 201183241 | 1/2009 |
| CN | 202862162 | 4/2013 |
| TW | M409137 | 8/2011 |
| TW | I358347 | 2/2012 |

OTHER PUBLICATIONS

Taiwan Patent Office Action and Search Report for Application No. 104123680 dated Oct. 14, 2016 (9 pages).

* cited by examiner

HAND TOOLS

CROSS-REFERENCE TO RELATED APPLICATIONS

This application is a continuation of co-pending U.S. patent application Ser. No. 14/805,039, filed Jul. 21, 2015, which claims priority to U.S. Provisional Patent Application No. 62/027,606 filed on Jul. 22, 2014; the entire contents of each is incorporated herein by reference.

BACKGROUND

The present invention relates to hand tools, and more particularly to multi-function hand tools.

SUMMARY

The invention provides, in one aspect, a hand tool including a body having a first end and a second end opposite the first end, a first reversible tool removably coupled to the first end, and a second reversible tool removably coupled to the second end. A first pick extends from the first reversible tool, and a second pick extends from the first reversible tool opposite the first pick. A first screwdriver bit extends from the second reversible tool, and a second screwdriver bit extends from the second reversible tool opposite the first screwdriver bit. The hand tool also includes a cap removably coupled to the body at the first end or the second end. The body is configured to resist rolling.

The invention provides, in another aspect, a hand tool including a body having a first end and a second end opposite the first end, and a first reversible tool removably coupled to the first end. The first reversible tool includes a hook and a straight pick extending from opposite ends of the first reversible tool. A second reversible tool is removably coupled to the second end. The second reversible tool includes a first screwdriver bit and a second screwdriver bit extending from opposite ends of the second reversible tool.

The invention provides, in another aspect, a hand tool including a body with a first end defining a cylindrical recess, a second end opposite the first end and defining a hexagonal recess, and a plurality of segments between the first end and the second end, wherein each of the segments has a non-circular cross-sectional shape. A first reversible tool is removably coupled to the cylindrical recess. The first reversible tool includes a hook and a straight pick extending from opposite ends of the first reversible tool. A second reversible tool is removably coupled to the hexagonal recess and includes a first screwdriver bit and a second screwdriver bit extending from opposite ends of the second reversible tool. The first screwdriver bit and the second screwdriver bit are integrally formed together as a single piece. The hand tool also includes a cap removably coupled to the body. The second screwdriver bit has a different fastener-engaging geometry than the first screwdriver bit.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
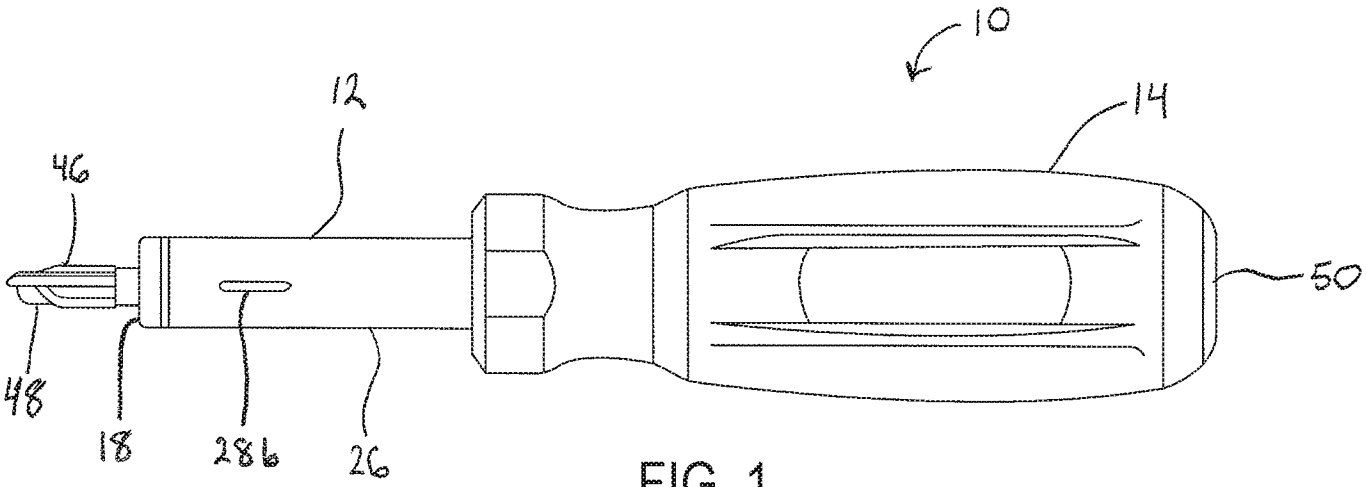
FIG. 1 is a side view of a hand tool according to one embodiment.

FIG. 1 illustrates a combination punchdown and screwdriver hand tool 10 according to one embodiment of the invention. The tool 10 is operable as a punchdown tool to terminate wires at a connector, cross-connect panel, terminal jack, or the like and also operable as a screwdriver to rotate and drive fasteners, such as screws and the like. The tool 10 includes a housing 12 and a handle 14.

Figure 2:
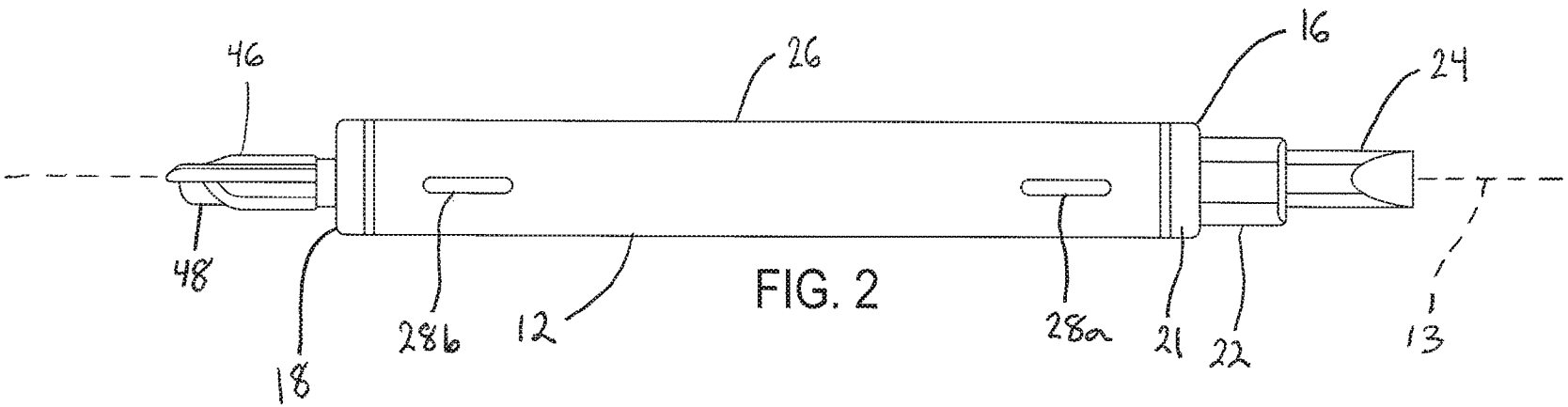
FIG. 2 is an enlarged side view of a portion of the hand tool of FIG. 1 with a handle removed.
Figure 4:
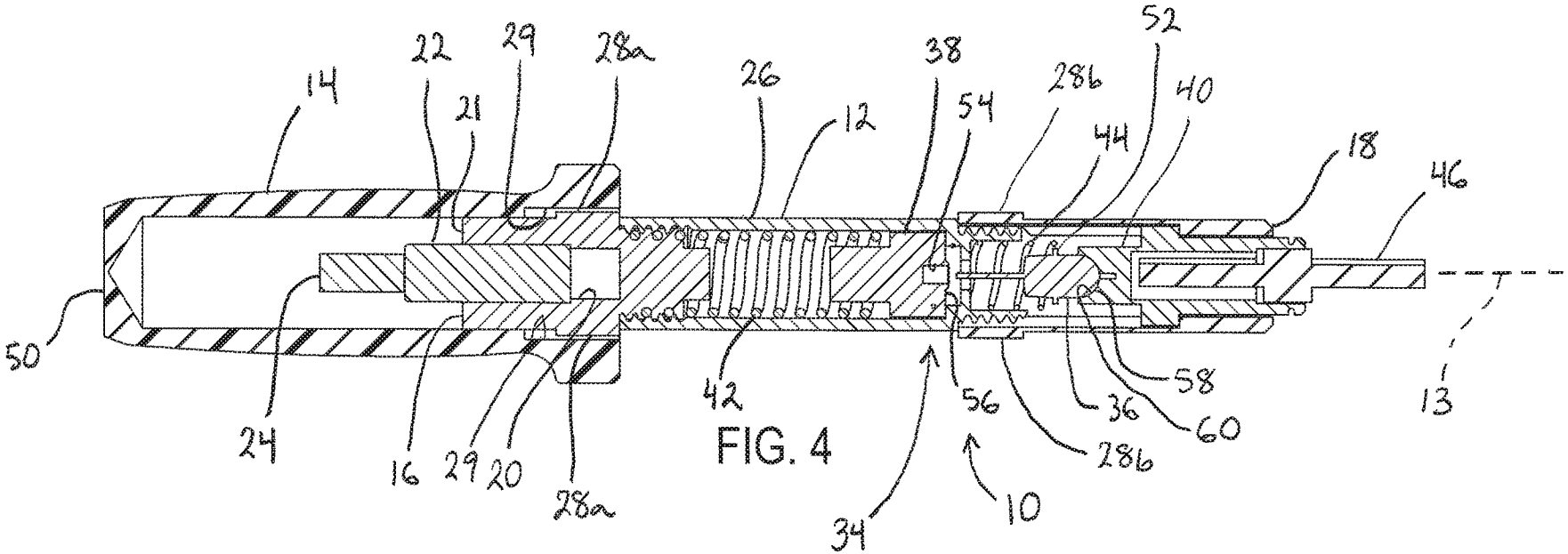
FIG. 4 is a cross-sectional view of the hand tool of FIG. 1, illustrating an impact mechanism according to one embodiment.

With reference to FIG. 2, the housing 12 includes a first end 16 and a second end 18. The housing 12 defines a longitudinal axis 13 extending between the first and second ends 16, 18. The first end 16 includes a recess 20 (FIG. 4). In the illustrated embodiment, the recess 20 is provided in an end member 21, which is coupled to the remainder of the housing 12 by a threaded connection. As such, the end member 21 and the recess 20 are fixed in the axial direction with respect to the housing 12.

The illustrated recess 20 is a hex-shaped recess that receives a first tool bit holder 22. In other embodiments, the recess 20 may have other internal geometries, such as a square shape, spline shape, and the like. The tool bit holder 22 receives a tool bit 24 such that the tool bit 24 extends beyond the first end 16 of the housing 12. The illustrated tool bit 24 is a flat screwdriver bit, but in other embodiments other types of bits may be used, such as a square drive, Robertson, Philips, and the like. The illustrated bit 24 is integrally formed with the tool bit holder 22 as a single piece. In other embodiments, the bit 24 is removable from the tool bit holder 22 such that the bit 24 is replaceable with other tools (e.g., interchangeable screwdriver bits). The tool bit holder 22 is reversible such that tool bit holder 22 can be held in the recess 20 with either the bit 24 extending from the housing 12 or with a different bit (not shown) that extends from the housing in an opposite direction from the bit 24.

The illustrated housing 12 includes a generally cylindrical portion 26 and tabs 28*a*, 28*b* that extend radially outwardly from the cylindrical portion 26 (FIG. 2). The tabs 28*a*, 28*b* are received in corresponding recesses or slots 29 in the handle 14 to inhibit rotation of the housing 12 relative to the handle 14 (FIG. 4). As such, when the user rotates the handle 14, the housing 12 and the tool bit 24 co-rotate with the handle 14.

The handle 14 and the housing 12 are removably coupled so that either the first end 16 or the second end 18 is received within the handle 14. When the first end 16 is received within the handle 14, the tabs 28*a* engage the recesses 29 of the handle 14. When the second end 18 is received within the handle 14, the tabs 28*b* engage the recesses 29 of the handle. Thus, the housing 12 is reversible relative to the handle 14 between a first position (FIGS. 1 and 4) in which the first end 16 is received within the handle 14 and a second position (not shown) in which the second end 18 is received within the handle 14. When the housing 12 is in the second position, the tool 10 is usable as a screwdriver. When the housing 12 is in the first position, the tool 10 is usable as a punchdown tool, as described in greater detail below.

Referring to FIG. 4, for use of the tool 10 as a punchdown tool, the tool 10 includes an impact mechanism 34 located within the housing 12. The illustrated impact mechanism 34 includes a pin ram 36, a hammer 38, and a second tool bit holder 40 slidably received within the housing 12. A first spring 42 biases the hammer 38 toward the pin ram 36 and a second spring 44 biases the pin ram 36 toward the bit holder 40. The first spring 42 is disposed between the hammer 38 and the end member 21, and the second spring 44 is disposed between the hammer 38 and the second tool bit holder 40.

Figure 3:
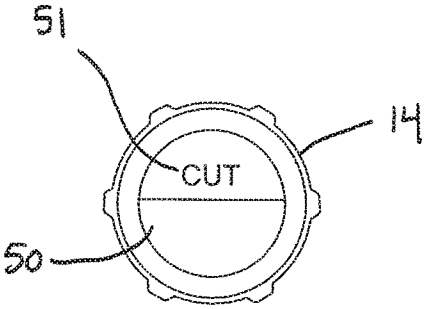
FIG. 3 is an end view of the hand tool of FIG. 1.

The tool bit holder 40 receives a removable punchdown tool bit 46 such that the punchdown tool bit 46 extends beyond the second end 18 of the housing 12. The punchdown tool bit 46 can include standard configurations such as a 110 or 66 style end. In some embodiments, the punchdown tool bit 46 is reversible and includes, for example, both 110 and 66 style ends. The illustrated bit 46 includes a cutting end 48 (FIG. 1) located on one side of the bit 46. During use, the cutting end 48 can cut away excess wire after a wire is punched down into a connector, for example. With reference to FIG. 3, an end 50 of the handle 14 includes indicia 51, which forms the word "CUT" in the illustrated embodiment, to indicate to the user what side of the bit 46 includes the cutting end 48.

In operation, when the tool bit 46 is pressed against a workpiece, the bit holder 40 and the pin ram 36 are displaced into the housing 12 against the bias of the spring 44. The spring 44 acts against a flange 52 of the pin ram 36, which causes the pin ram 36 to be slightly misaligned with a bore 54 of the hammer 38. As such, the pin ram 36 presses against a peripheral edge 56 surrounding the bore 54 to displace the hammer 38 against the biasing force of the spring 42. As the pin ram 36 and the hammer 38 are displaced, an end 58 of the pin ram 36 interfaces with a recess 60 of the bit holder 40 to eventually align the pin ram 36 with the bore 54 of the hammer 38. When the pin ram 36 is aligned with the bore 54, the pin ram 36 abruptly enters into the bore 54 of the hammer 38, and the hammer 38 drops and impacts the pin ram 36. This imparts an axial impact to the bit holder 40, and therefore, to the tool bit 46.

To operate the tool 10 as a screwdriver, the user removes the housing 12 from the handle 14, then reverses the housing 12 and inserts the second end 18 into the handle 14. The recesses 29 in the handle 14 receive the tabs 28*b* to inhibit relative rotation between the housing 12 and the handle 14. The screwdriver bit 24 can be used to perform a desired operation on a fastener or other workpiece. Because the end member 21 is threaded into the housing 12, pressure on the bit 24 does not result in the tool bit holder 22 being displaced into the housing 12. Accordingly, the impact mechanism 34 is not actuated when the tool 10 is used as a screwdriver.

Figure 5:
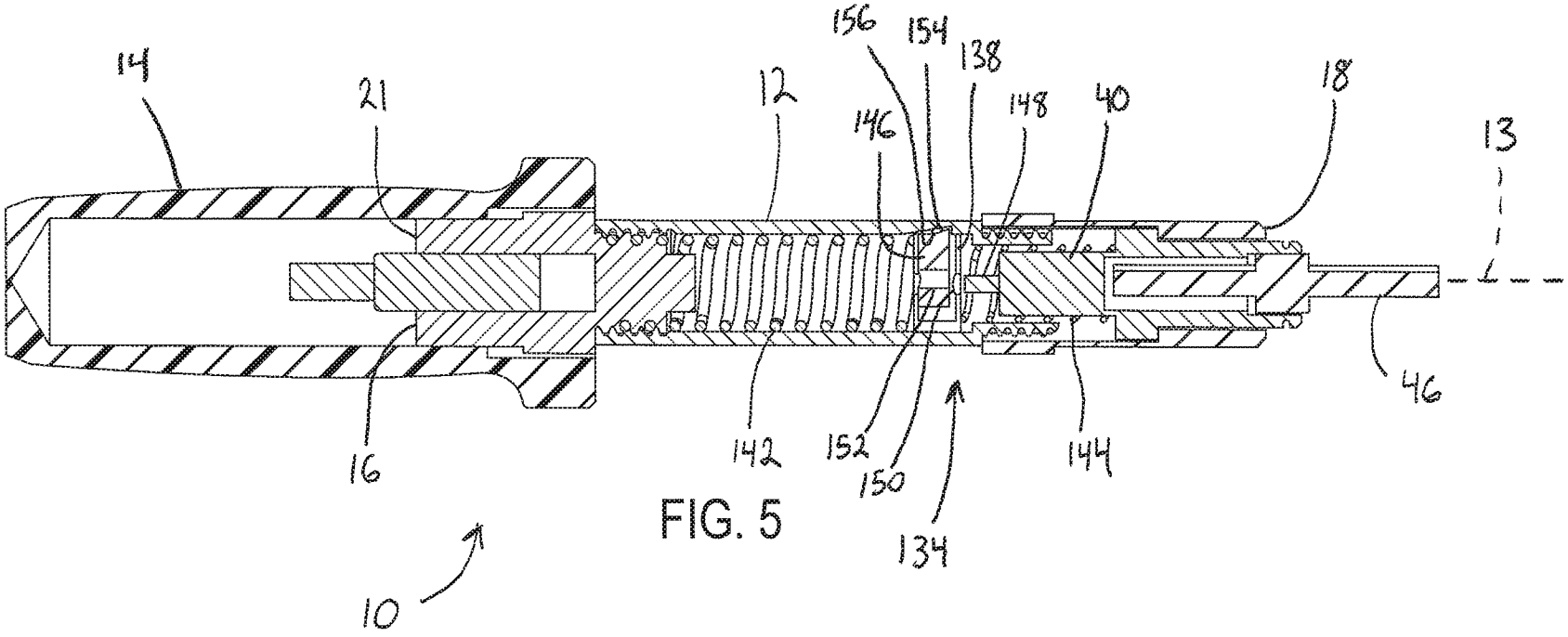
FIG. 5 is a cross-sectional view of the hand tool of FIG. 1, illustrating an impact mechanism according to another embodiment.

FIG. 5 illustrates an impact mechanism 134 according to another embodiment that can be incorporated into the housing 12 for use with the hand tool 10. The impact mechanism 134 includes a hammer 138 slidably disposed within the housing 12 for movement along the longitudinal axis 13, a first spring 142 disposed between the end member 21 and the hammer 138, a second spring 144 disposed between the second tool bit holder 40 and the hammer 138, and a sear or catch 146 received within the hammer 138. The first spring 142 biases the hammer 138 toward the tool bit holder 40, and the second spring 144 biases the tool bit holder 40 away from the hammer 138.

The tool bit holder 40 includes a pin 148 extending toward the first end 16 of the housing 12 that is aligned with an aperture 150 in the hammer 138. The sear 146 includes an aperture 152 that is normally misaligned with the pin 148. An engagement portion 154 on the sear 146 bears against a ramped surface 156 formed in the housing 12 to move the sear 146 into the hammer 138 and thereby align the aperture 152 with the pin 148. Thus, the sear 146 is movable relative to the hammer 138 in a direction that is generally transverse to the longitudinal axis 13 to selectively align the aperture 152 with the pin 148. A biasing member (e.g., a spring, not shown) is provided to bias the sear 146 into engagement with the ramped surface 156.

Figure 6:
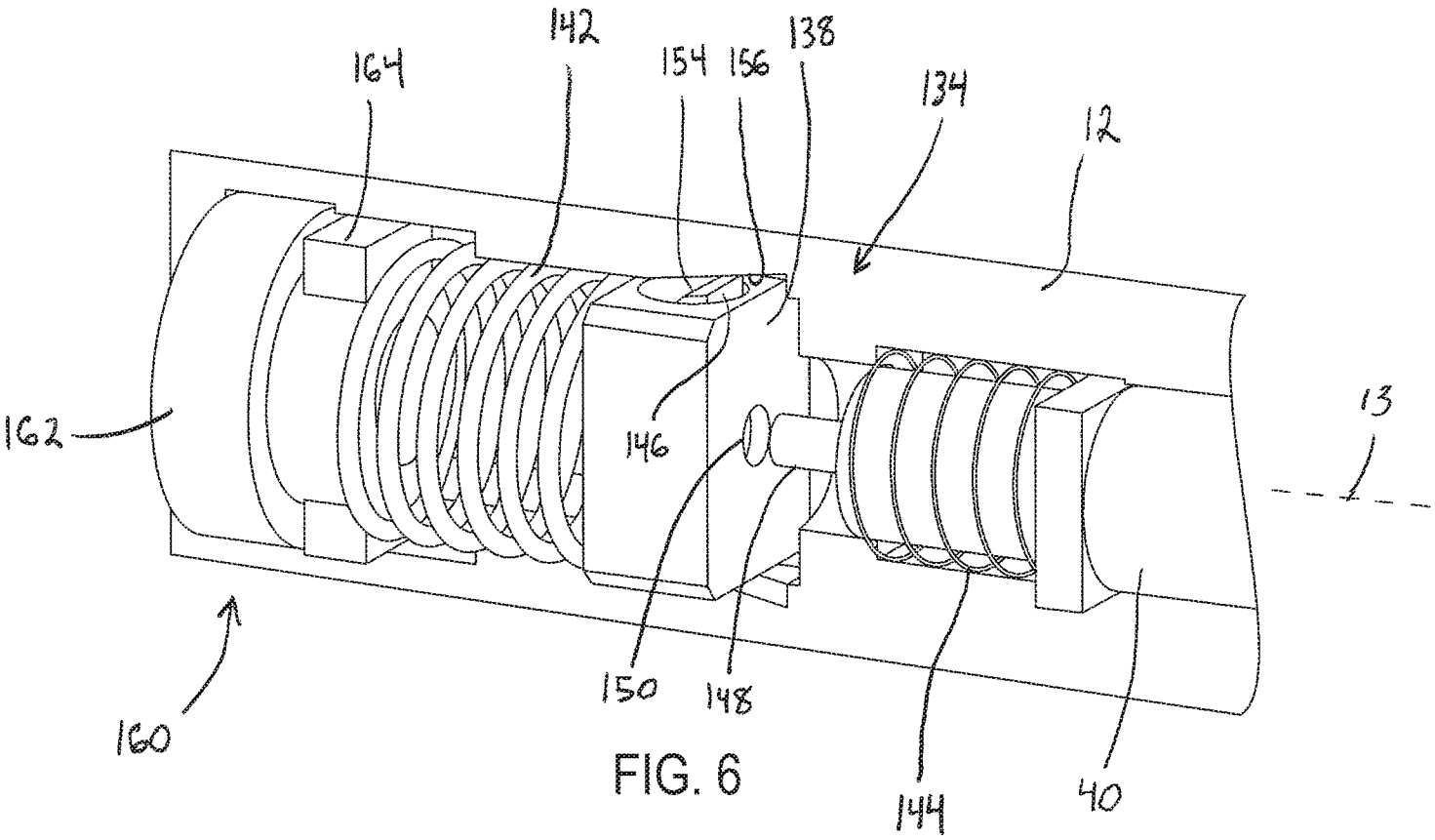
FIG. 6 is a perspective view of the impact mechanism of FIG. 5 including an adjustment mechanism.

FIG. 6 illustrates an adjustment assembly 160 that can be used in conjunction with the impact mechanism 134 to vary a preload force on the first spring 142. In other embodiments, the adjustment assembly 160 can be used in conjunction with the impact mechanism 34 to vary a preload force on the first spring 42. The illustrated adjustment assembly 160 includes an actuator 162 and a slider 164. The slider 164 abuts an end of the first spring 142. The actuator 162 is coupled to the slider 164 such that rotation of the actuator 162 causes the slider 164 to translate along the longitudinal axis 13 to compress or decompress the spring 142.

In operation, when the tool bit 46 is pressed against a workpiece, the bit holder 40 is displaced into the housing 12 against the bias of the spring 144 (FIG. 5). As the bit holder 40 is displaced, the pin 148 passes through the aperture 150 in the hammer 138 and engages the sear 146. Continued displacement of the bit holder 40 causes the sear 146 and the hammer 138 to move together with the bit holder 40 towards the first end 16, compressing the first spring 142. The sear 146 bears against the ramped surface 156 in the housing 12, gradually displacing the sear 146 into the hammer 138 and aligning the aperture 152 in the sear 146 with the pin 148. Once the sear 146 is displaced far enough by the ramped surface 156, the aperture 152 in the sear 146 is aligned with the pin 148, and the hammer 138 is abruptly released to impact the bit holder 40. This imparts an axial impact to the tool bit 46.

Figure 7:
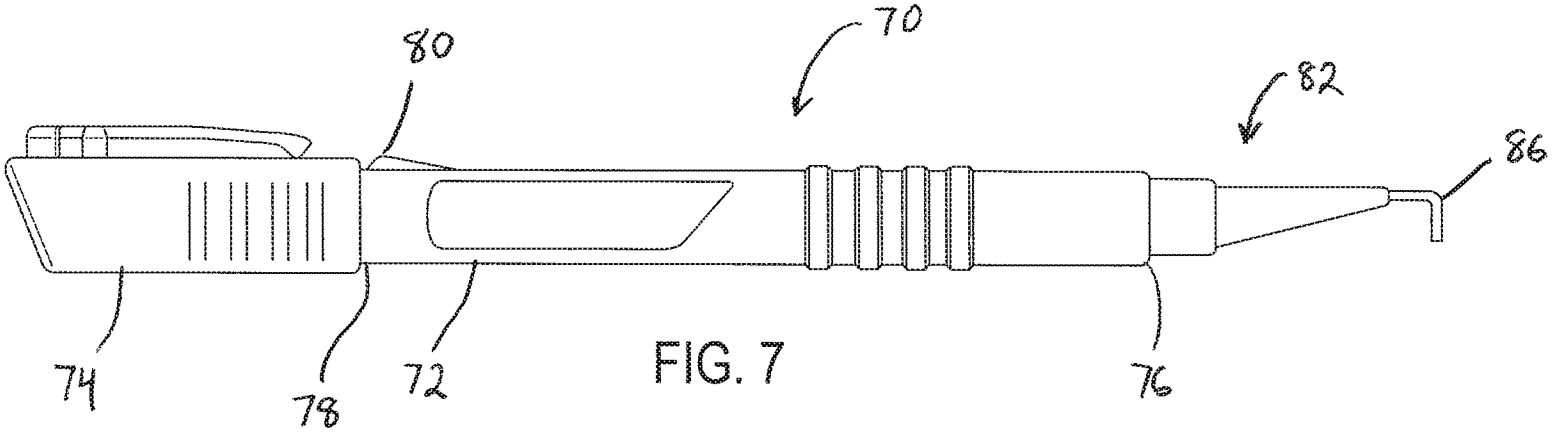
FIG. 7 is a side view of a hand tool according to one embodiment.
Figure 11:
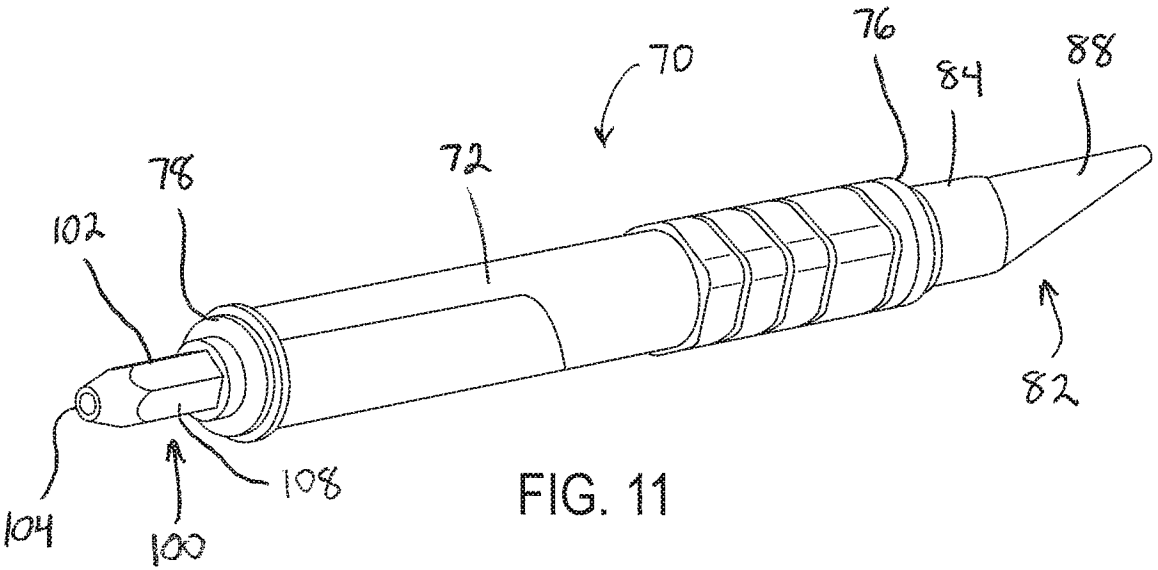
FIG. 11 is a perspective view of the hand tool of FIG. 7 with a cap removed.
Figure 12:
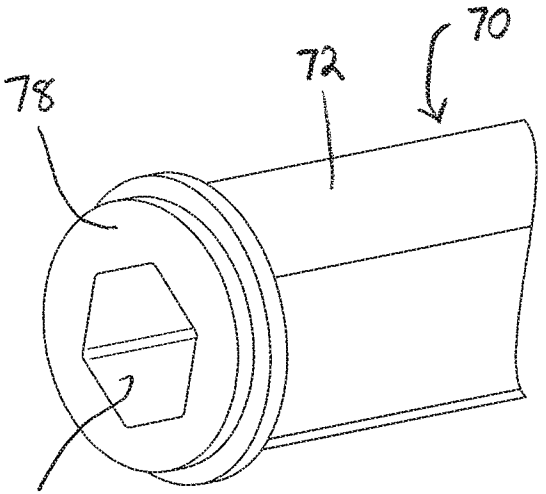
FIG. 12 is a perspective view of a portion of the hand tool of FIG. 7 with a bit holder removed.

FIGS. 7-13 illustrate a hand tool 70 according to another embodiment. The hand tool 70 is a combination precision screwdriver and spudger tool. Referring to FIGS. 7 and 11, the tool 70 includes a body 72 and a cap 74. The body 72 is generally hollow and includes a first end 76 and a second end 78. A fin 80 is located near the second end 78 and the fin 80 inhibits the body 72 from rolling on flat surfaces.

Figure 8:
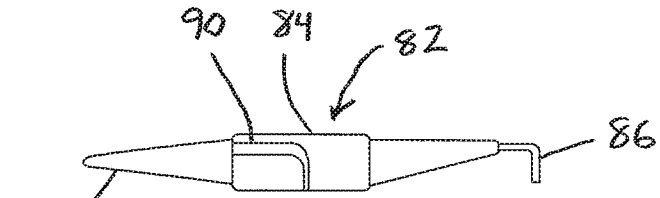
FIG. 8 is a side view of a tool of the hand tool of FIG. 7.

A first tool 82, which is a reversible spudger tool in the illustrated embodiment, is received in the first end 76 of the body 72. Referring to FIG. 8, the illustrated spudger tool 82 includes a body 84, a first pick 86 that extends from one end of the body 84, and a second pick 88 that extends from a second end of the body 84. The illustrated pick 86 is a 90 degree bent pick and the pick 88 is a straight plastic pick. The body 84 includes recesses or slots 90 formed on opposite sides of the body 84 (only one is visible in FIG. 8). Each of the slots 90 is sized and shaped to receive a pin 92 (FIG. 10) to removably couple the tool 82 to the body 72. In the illustrated embodiment, one of the slots 90 is engageable with the pin 92 to secure the tool 82 relative to the body 72 in a first position in which the first pick 86 extends from the body 72 and the second pick 88 is received within the body 72. The other of the slots 90 is engageable with the pin 92 to secure the tool 82 relative to the body 72 in a second position (FIG. 11) in which the second pick 88 extends from the body 72 and the first pick 86 is received within the body 72.

Figure 9:
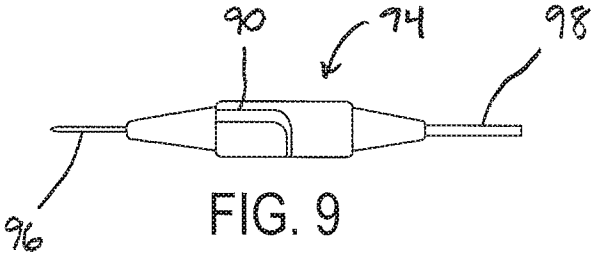
FIG. 9 is a side view of a second tool of the hand tool of FIG. 7.
Figure 10:
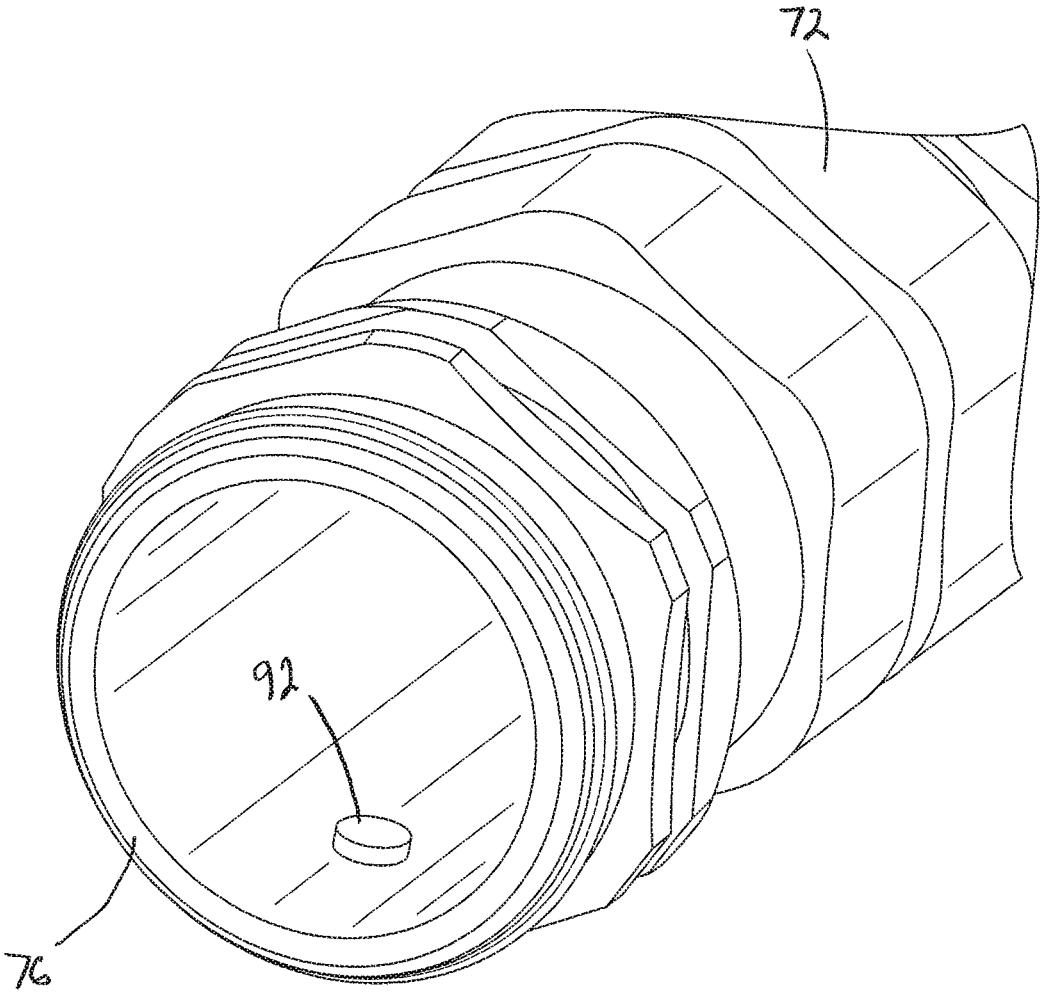
FIG. 10 is a perspective view of a portion of the hand tool of FIG. 7 with the tool removed.

FIG. 9 illustrates a second spudger tool 94 that can be used with the hand tool 70. The spudger tool 94 includes straight picks 96, 98 extending in opposite directions. The second spudger tool 94 can be used as a replacement for the first tool 82.

Figure 13:
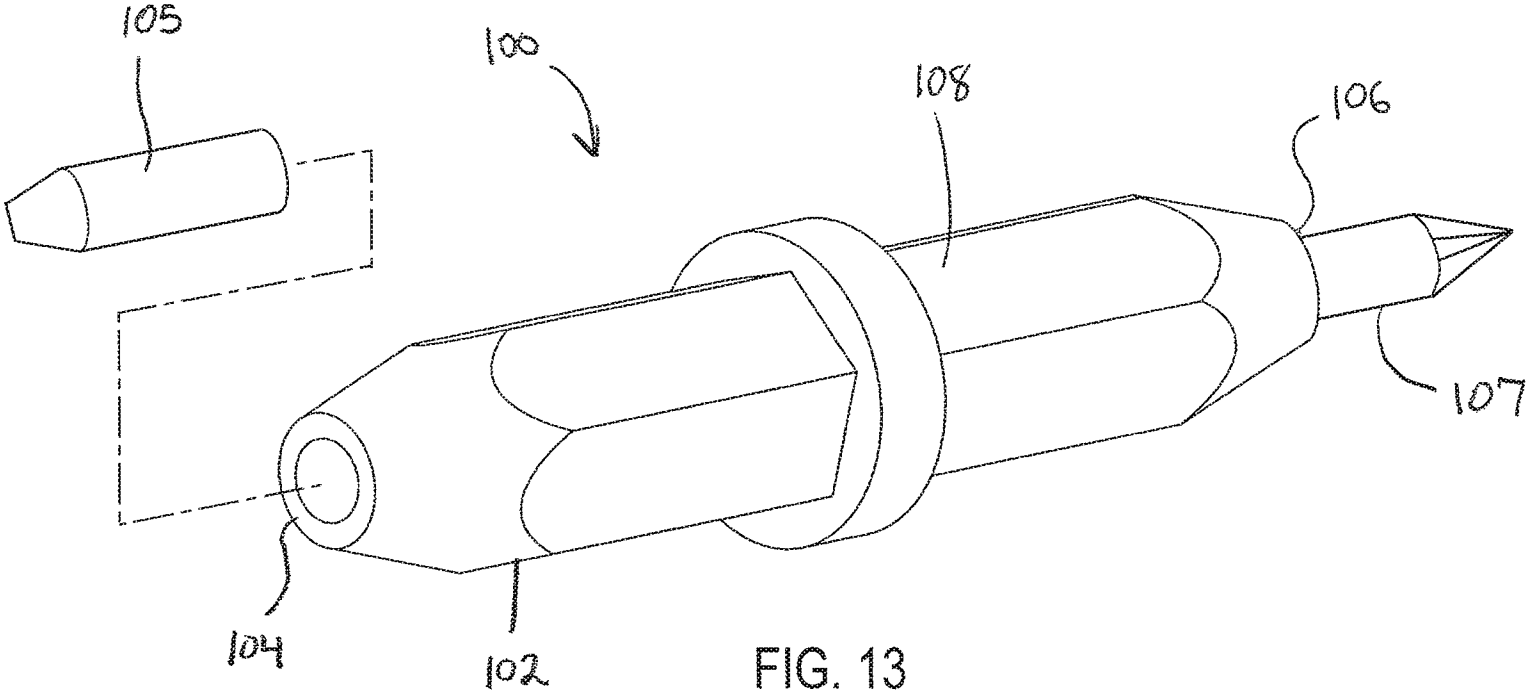
FIG. 13 is a perspective view of the bit holder of the hand tool of FIG. 7.
Figure 14:
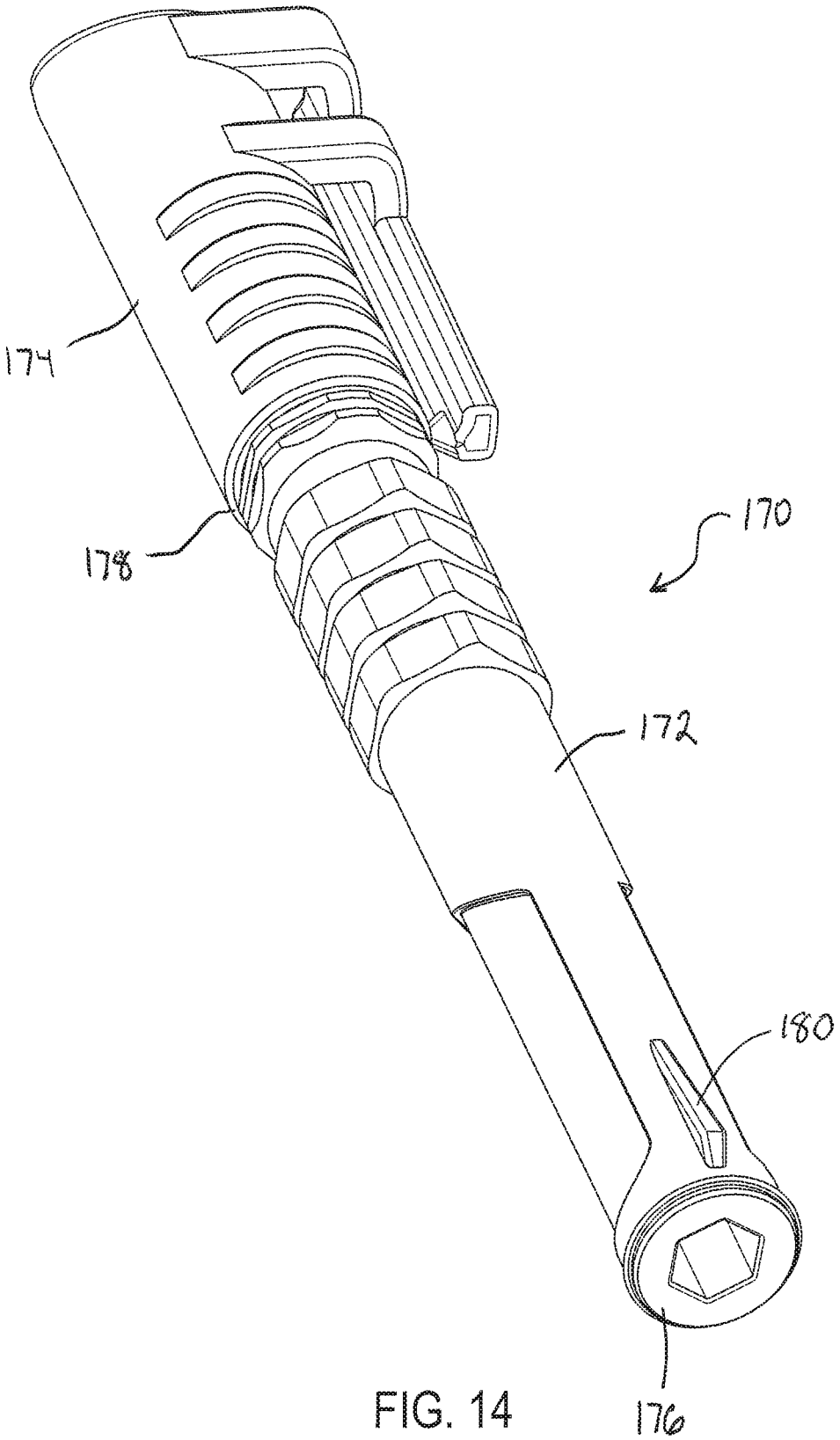
FIG. 14 is a perspective view of a hand tool according to one embodiment.
Figure 15:
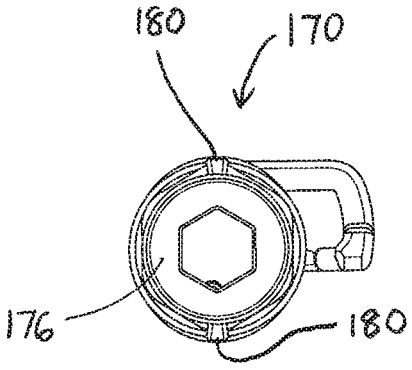
FIG. 15 is a front view of the hand tool of FIG. 14.
Figure 16:
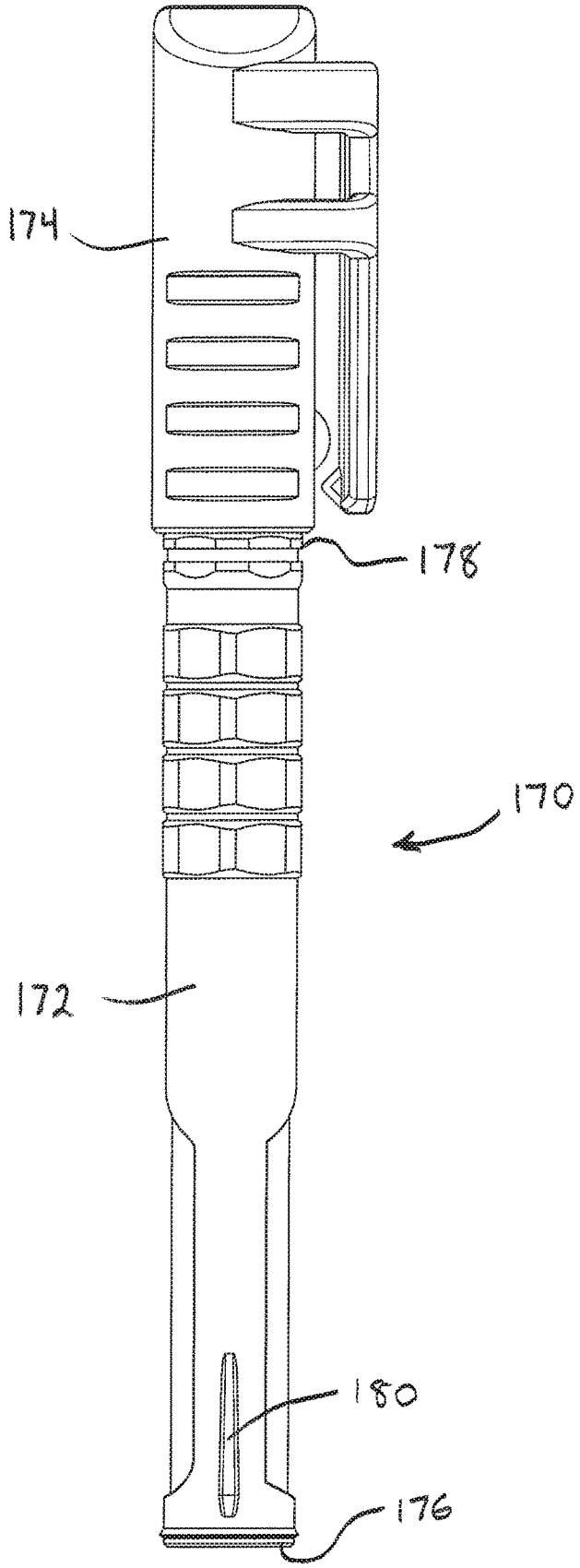
FIG. 16 is a top view of the hand tool of FIG. 14.
Figure 17:
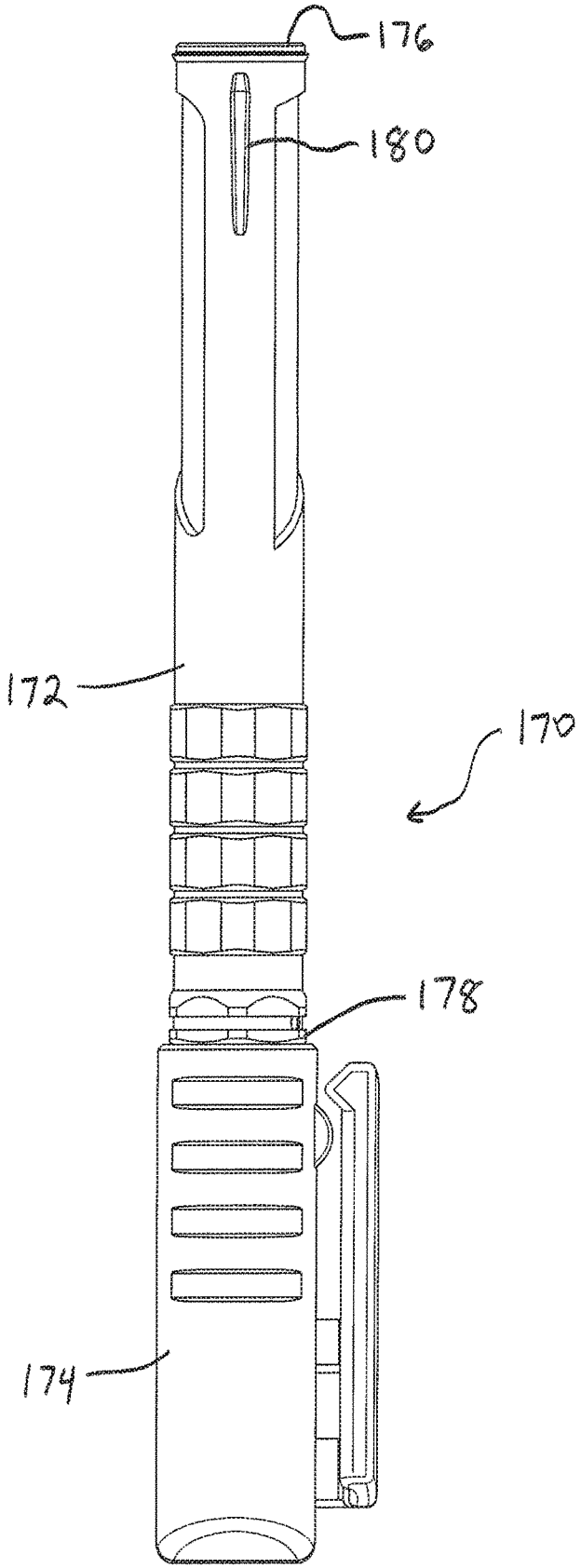
FIG. 17 is a bottom view of the hand tool of FIG. 14.
Figure 18:
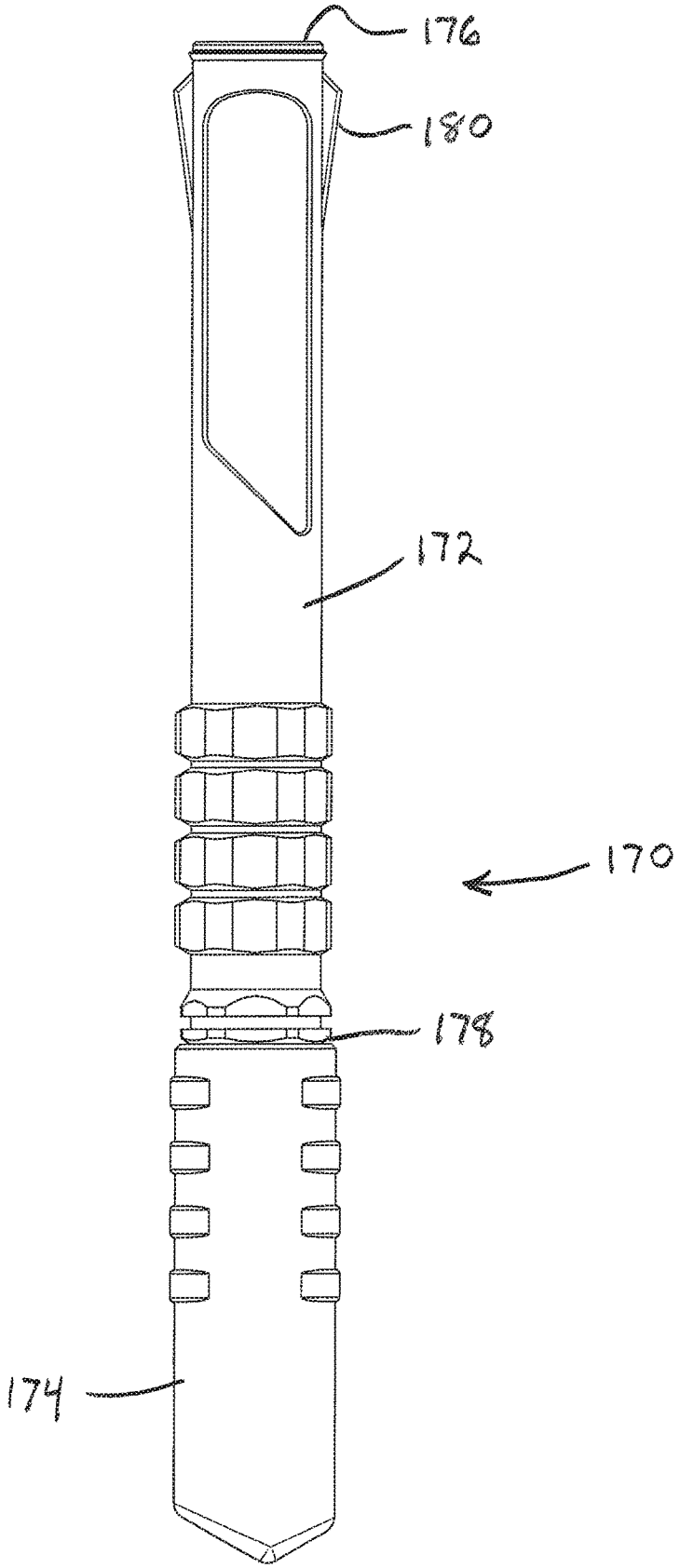
FIG. 18 is a left view of the hand tool of FIG. 14.
Figure 19:
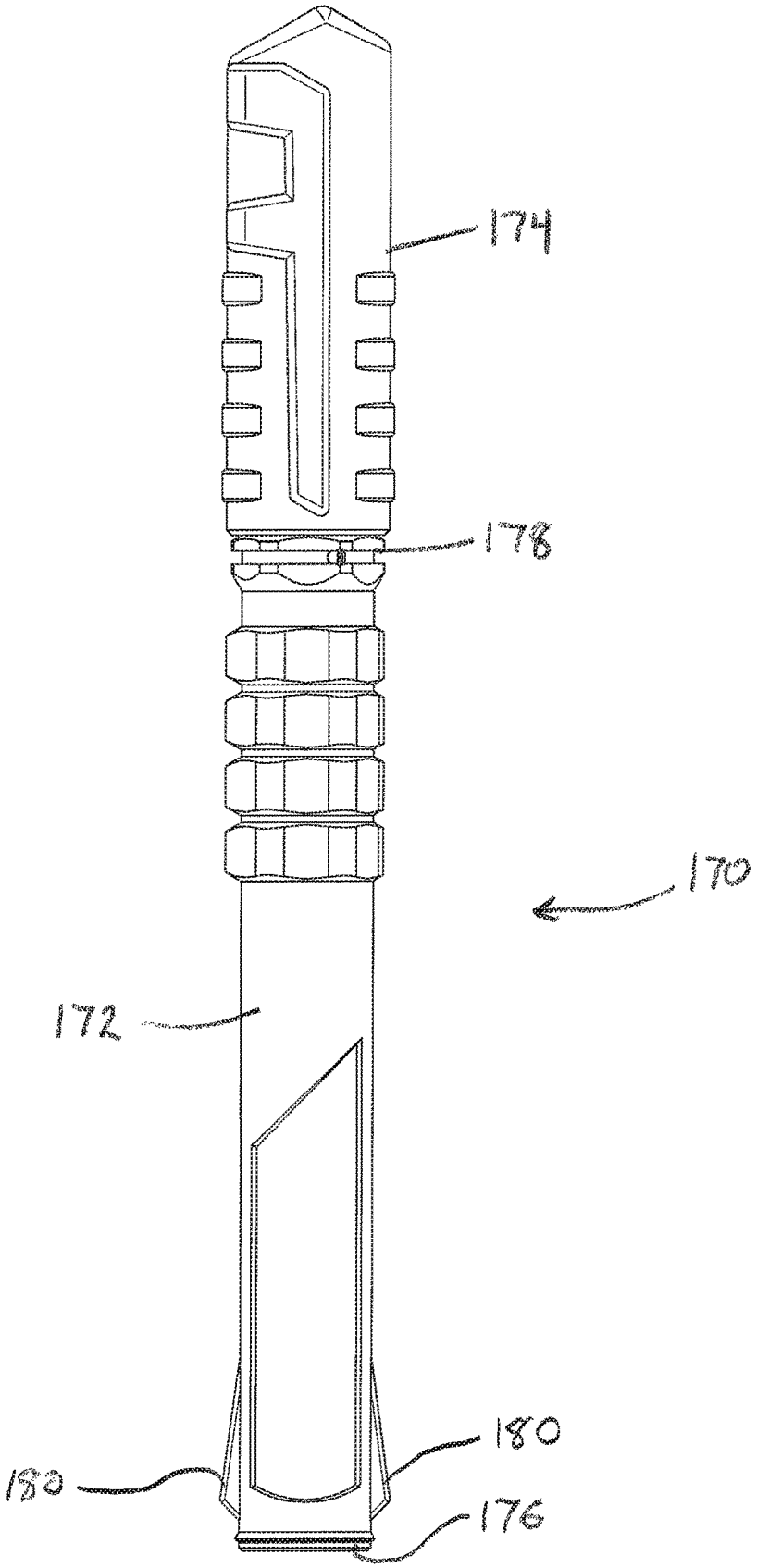
FIG. 19 is a right view of the hand tool of FIG. 14.
Figure 20:
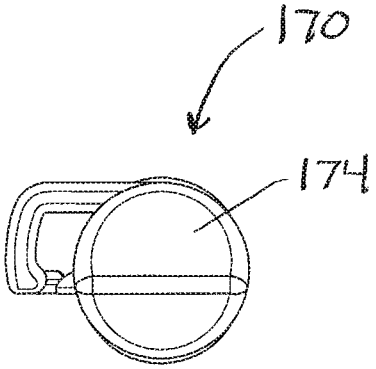
FIG. 20 is a rear view of the hand tool of FIG. 14.

With reference to FIG. 11, a second tool 100 is received in the second end 78 of the body 72. Referring to FIG. 13, the second tool 100 includes a tool body 102. The tool body 102 includes a first end 104 and a second end 106. A first precision screwdriver bit 105 is coupled to the first end 104, and a second precision screwdriver bit 107 is coupled to the second end 106. The screwdriver bits 105, 107 can be removably coupled to the tool body 102. Alternatively, one or both of the screwdriver bits 105, 107 can be integrally formed (e.g., molded) with the body 102 as a single piece.

The tool body 102 includes a hex-shaped outer surface 108 that is received in a hex-shaped recess 110 (FIG. 12) of the second end 78 of the body 72. The body 102 can be received in the recess 110 with either the first end 104 or the second end 106 extending from the body 72. Accordingly, the second tool 100 provides reversible precision screwdriver bits, and the tool 70 provides the user with multiple spudger tools and multiple precision screwdrivers on a single tool.

FIGS. 14-20 illustrate a hand tool 170 according to another embodiment. Like the hand tool 70 described above with reference to FIGS. 7-13, the hand tool 170 is a combination precision screwdriver and spudger tool. The tool 170 includes a body 172 and a cap 174. The body 172 is generally hollow and includes a first end 176 and a second end 178. A pair of fins 180 is located near the first end 176 to inhibit the body 172 from rolling on flat surfaces. The hand tool 170 is configured to receive tools, such as the first tool 80 and the second tool 100 described above, thereby providing the user with multiple spudger tools and multiple precision screwdrivers on a single tool.

Various features of the invention are set forth in the following claims.

What is claimed is:

1. A hand tool comprising:

a body comprising:

a first end;

a second end opposite the first end;

a first group of tabs extending radially outward from the body at the first end; and a second group of tabs extending radially outward from the body at the second end;

a handle removably coupled to the body such that the body is reversible relative to the handle between a first position, in which the first end of the body is received within the handle and a second position, in which the second end of the body is received within the handle;

a first reversible tool bit received within the body at the first end; and a second reversible tool bit received within the body at the second end;

wherein the handle includes a pair of opposing recesses positioned within the handle such that when the tool is in the first position the first group of tabs engage the recesses and when the tool is in the second position the second group of tabs engage the recesses, wherein engagement between the first group of tabs or the second group of tabs and the recesses inhibits rotation of the body relative to the handle such that body and tool bit co-rotate with the handle;

wherein the body further includes an end member, the end member including a first end that defines a recess and a second end opposite the first end and coupled to the body by a threaded connection, wherein the first group of tabs is positioned along the body between the first end and the second end of the end member and wherein the second group of tabs is positioned along the body between a tool bit holder located at the second end of the body and the second end of the end member.

2. The hand tool of claim 1, wherein the first tool bit includes a cutting end located on one side of the first tool bit.

3. The hand tool of claim 1, wherein the body includes an impact mechanism located at the second end of the body, positioned within the body along a longitudinal axis extending between the first and second ends of the body.

4. The hand tool of claim 3, wherein the impact mechanism includes a pin ram, a hammer, and the tool bit holder slidably received within the body.

5. The hand tool of claim 4, wherein a first spring is disposed between the hammer and the end member, and a second spring is disposed between the hammer and the tool bit holder.

* * * * *